United States Patent [19]

Flaherty et al.

[11] 3,981,105

[45] Sept. 21, 1976

[54] LAPIDARY APPARATUS

[75] Inventors: John W. Flaherty, Galesburg, Ill.; Robert C. Ingersoll; William F. Goodrich, both of Adrian, Mich.

[73] Assignee: Dick Blick Company, Galesburg, Ill.

[22] Filed: Mar. 17, 1975

[21] Appl. No.: 559,265

[52] U.S. Cl. ..... 51/71; 51/98 R; 51/109 R; 51/267; 51/272

[51] Int. Cl.[2] ..... B24B 7/08; B24B 55/02

[58] Field of Search ..... 51/5 C, 71, 72 R, 98 R, 51/102, 109 R, 128, 229, 267, 268, 272, 12 S; 125/3, 5, 30

[56] References Cited

UNITED STATES PATENTS

| | | | |
|---|---|---|---|
| 2,137,405 | 11/1938 | McD. Johns | 51/229 X |
| 2,415,575 | 2/1947 | Brabazon | 51/98 R |
| 2,762,172 | 9/1956 | Franklin | 51/128 X |
| 2,841,926 | 7/1958 | Lebus | 51/128 X |
| 3,210,893 | 10/1965 | Jackson | 51/109 X |
| 3,376,671 | 4/1968 | Wolter | 51/128 X |
| 3,498,007 | 3/1970 | Janicki | 51/109 |
| 3,755,971 | 9/1973 | Garcia | 51/102 X |

FOREIGN PATENTS OR APPLICATIONS

| | | | |
|---|---|---|---|
| 1,255,770 | 12/1971 | United Kingdom | 51/98 R |

*Primary Examiner*—Al Lawrence Smith
*Assistant Examiner*—Nicholas P. Godici
*Attorney, Agent, or Firm*—Harry O. Ernsberger

[57] ABSTRACT

The disclosure embraces an apparatus or machine for processing stones by cutting, grinding, lapping or polishing operations and more especially to a compact portable apparatus or machine for processing stones used for jewelry and decorative purposes, the apparatus including a housing construction having surface areas whereby the apparatus may be mounted or supported in selected positions whereby a rotatable stone-processing instrumentality of the apparatus may be disposed for rotation in a vertical plane or the stone-processing instrumentality disposed for rotation in a horizontal plane.

11 Claims, 15 Drawing Figures

LAPIDARY APPARATUS

This invention relates to an apparatus or machine for processing stones by cutting, abrading, lapping or polishing and especially for use by lapidaries for processing stones used for jewelry and decorative purposes. Heretofore machines of lapidary character have been constructed wherein the machine or apparatus is adapted for use with the grinding wheel disposed in one position.

The invention embraces a stone processing machine or apparatus constructed and arranged to provide for convenient use of a rotatable stone processing instrumentality in more than one position through the provision of multiple planar surface areas of the housing whereby the machine or apparatus may be mounted or supported for use in different positions.

An object of the invention resides in a stone processing lapidary machine or apparatus of compact construction and embodying a rotatable stone processing instrumentality and accessory components arranged whereby the rotatable stone processing instrumentality is rendered usable in different positions by shifting the position of the housing of the machine or apparatus with respect to a support.

Another object of the invention resides in a stone processing machine or apparatus wherein the housing of the machine or apparatus is configurated to be supported whereby the rotatable stone processing instrumentality may be used in different planes and wherein a change in position of the housing requires only the repositioning of the tank or reservoir for supplying a controlled stream of water or other liquid for use in stone processing operations and affixing a water deflecting baffle to the housing adjacent the rotatable stone processing instrumentality when the latter is disposed for use in a horizontal plane.

Another object of the invention resides in a lapidary machine or apparatus usable in several positions and wherein the apparatus is provided with a drain tube for draining away the water used in stone processing operations irrespective of whether the rotatable stone processing instrumentality is disposed for rotation in a horizontal plane or disposed for rotation in a vertical plane.

Another object of the invention resides in a lapidary machine or apparatus for processing stones wherein interchangeable stone supporting tables are provided for effecting stone cutting or severing operations and for effecting stone grinding, polishing or lapping operations.

Another object of the invention resides in adjustable means for directing a stream of water onto a particular region of a rotatable stone processing instrumentality.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 3:
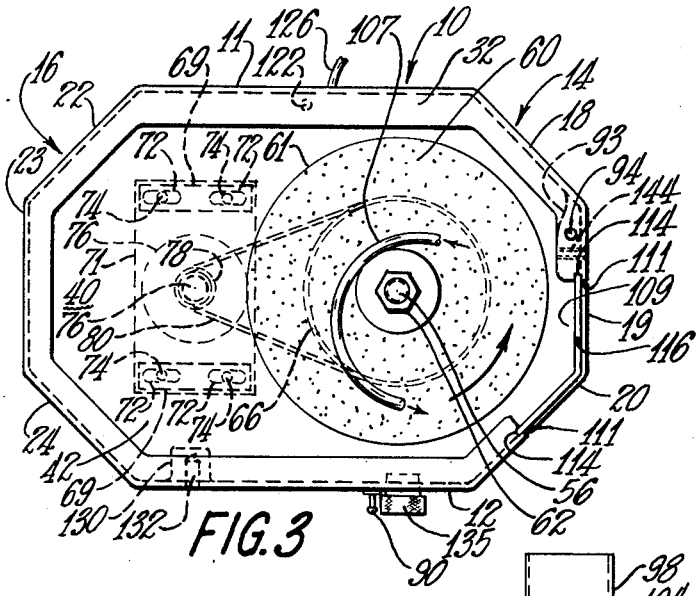
FIG. 3 is a top plan view of the apparatus illustrated in FIG. 1 with a water supply reservoir removed.
Figure 4:
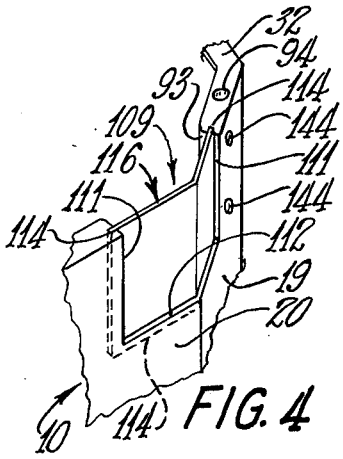
FIG. 4 is a fragmentary isometric view of a portion of the housing illustrating a removable baffle construction.

In the illustrated embodiment the housing of the lapidary machine or apparatus is of generally octagonal shape with elongated side wall areas providing a compact enclosure, the housing being preferably formed of molded resinous or plastic material to reduce the weight and enhance the portability of the lapidary machine or apparatus. The housing is configurated to provide planar surface areas whereby the apparatus may be disposed for use in different positions, in one position the rotatable stone processing instrumentality being disposed in a horizontal plane, and in a second position disposing the rotatable stone processing instrumentality for rotation in a vertical plane.

Referring to the drawings and initially to FIGS. 1 through 5, the housing or frame 10 of the apparatus is fashioned with elongated opposed walls 11 and 12 and end walls or regions 14 and 16. The end wall 14 is fashioned as facets or surfaces 18, 19 and 20 as a portion of an octagon, and the end wall 16 is similarly fashioned with facets or surfaces 22, 23 and 24 as a portion of an octagon. It is to be understood that the end walls 14 and 16 of the housing may be of different configuration as, for example, semicircular or having a greater or lesser number of facets if desired.

Figure 1:
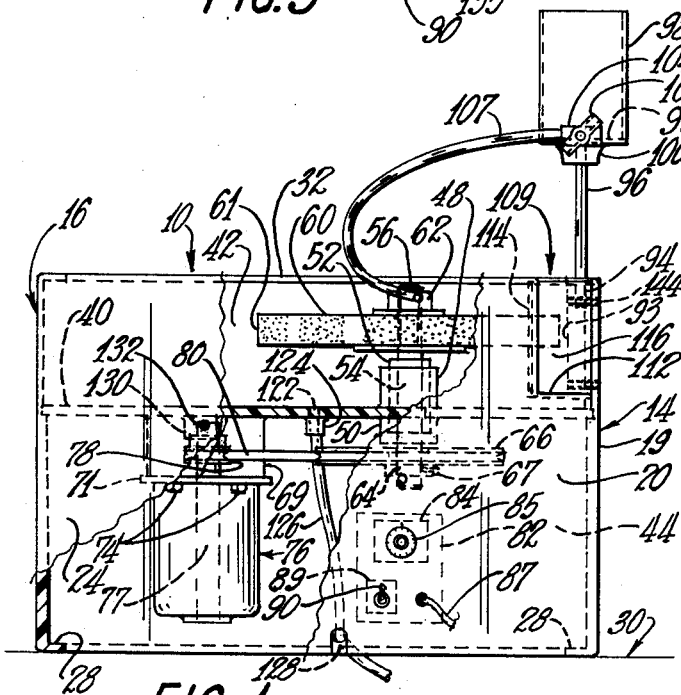
FIG. 1 is an elevational view of a form of stone processing apparatus of the invention with a rotatable stone processing instrumentality in horizontal position.
Figure 2:
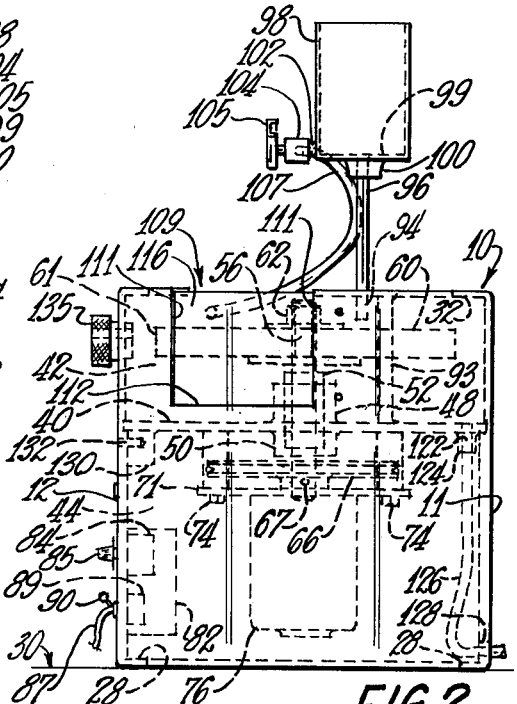
FIG. 2 is an end view of the apparatus shown in FIG. 1.

As shown in FIGS. 1 and 2, the lower termini of the walls 11 and 12 and the end walls 14 and 16 are integrally joined or molded with an inwardly extending peripheral flange or ledge 28, the exterior surface of the flange 28 being planar and adapted to be supported or disposed upon any means providing a substantially horizontal supporting surface 30 in which position stone processing operations, such as grinding, lapping and polishing, are performed upon a side or planar surface of the rotatable processing instrumentality or wheel with the latter in a substantially horizontal position.

The upper termini of the walls 11 and 12 and the end walls 14 and 16 are integrally joined or molded with an inwardly extending flange or ledge 32 providing reinforcement for the housing or frame construction and functioning as a splash guard to confine water thrown from the stone-processing instrumentality.

In the embodiment illustrated in FIGS. 1 through 5, the walls 11 and 12 and the walls of the end regions 14 and 16 are fashioned or molded with a ledge 34. The ledge is provided by reason of the thickened regions 36 of the walls 11 and 12 and the end walls 14 and 16, the ledge being disposed at a distance of about one-third of the height of the housing from the top of the housing as particularly shown in FIG. 5.

Supported upon the ledge 34 is a member, plate or partition 40 which is imperforate except for an opening accommodating a bearing construction mounting a shaft for supporting a rotatable stone processing instrumentality such as an abrasive wheel or a cutting wheel. The partition 40 defined two chamber regions or compartments 42 and 44. The partition 40 is preferably fashioned of molded resinous material and, in the form shown in FIGS. 1 through 3 and 5, the peripheral region of the partition 40 is secured or cemented to the walls of the housing by cementitious material 46.

The cementitious material 46 forms a fluid tight seal between the peripheral region of the partition 40 and the housing walls as the chamber or compartment 42 above the partition collects water or other liquid that may be delivered onto the rotatable stone processing instrumentality.

The partition 40 is formed with aligned boss portions 48 and 50 extending from each side of the partition, as shown in FIGS. 1 and 2. The bosses 48 and 50 are fashioned with a bore accommodating a bearing assembly of conventional construction including a sleeve 52 containing antifriction bearing means such as bearing balls (not shown) which journally support a shaft 54. The shaft 54 has a threaded tenon portion 56 of lesser diameter than the portion of the shaft within the bearing sleeve 52 providing a ledge which forms an abutment for a stone processing instrumentality 60 which, as shown in FIGS. 1, 2 and 3, is an abrasive or grinding wheel.

The grinding wheel or instrumentality 60 is received upon the tenon portion 56 of the shaft 54 and a nut 62 secures the wheel 60 on the shaft. As shown in FIGS. 1 and 2, with the flange 28 of the housing disposed on a horizontal support 30, the wheel 60 is in a horizontal plane and rotates about the axis of the shaft 54 which is in a vertical position.

Mounted upon the shaft 54 below the boss 50 is a driven pulley or sheave 66 secured to the shaft by a setscrew 67. The partition 40 is arranged to support an electrically operated motor for driving or rotating the stone processing instrumentality 60. The partition 40 is formed with two laterally spaced depending bosses or projections 69, each boss having two threaded openings. A motor mounting plate or member 71 of generally rectangular shape is provided with four slots 72 which are aligned with the threaded openings in the projections 69.

Bolts or threaded members 74 secure the plate 71 to the projections 69. The plate 71 is secured to the housing of an electrically energizable motor 76. The shaft 77 of the motor 76 is equipped with a sheave or pulley 78 which is connected with the sheave or pulley 66 by a driving belt 80 for rotating the stone processing wheel 60. The tension in the driving belt 80 may be adjusted by adjusting the motor mounting plate 71, adjustmemnt being provided by the elongated slots 72 in the plate 71.

Disposed in the compartment 44 and secured to the interior surface of wall 12 of the housing is a receptacle or box 82 containing a variable speed control unit 84, the unit being provided with an adjusting dial or member 85 which may be manipulated by the operator to vary the speed of the motor 76. A conductor 87 is adapted to be connected with an electric current supply for conducting current to the motor control unit 84. A switch 89 contained in the receptacle 82 has a manipulating member 90 for controlling the switch and hence the current to the motor 76.

As shown in FIG. 1, the inwardly extending flange 28 of the housing may be mounted upon a horizontal supporting surface 30 whereby the abrasive or grinding wheel 60 is rotatable in a substantially horizontal plane. In the use of the wheel in the position shown in FIGS. 1 through 3, the operator processes the stones by engaging them with the upper horizontal planar surface of the wheel 60.

In processing stones it is a usual practice to direct a stream of liquid, such as water, onto the processing or grinding wheel to facilitate grinding or polishing the stones. The end wall or region 19 of the housing is provided with a boss portion 93 beneath the inwardly extending flange 32. A bore 94 is molded or drilled into the boss portion 93. The bore or cylindrical recess 94 accommodates a rod-like member 96 which is slidably removable from the bore 93. The rod supports a receptacle, reservoir or tank 98 which may be molded of resinous plastic or other suitable material and is adapted to contain a supply of water or other liquid.

The floor or bottom 99 of the receptacle is fashioned with a depending boss 100 which is formed with a cylindrical recess or bore extending partially through the boss 100 to receive the upper end of the member 96, the rod 96 supporting the receptacle 98. A short pipe 102 is secured in an opening in a side wall of the receptacle 98 adjacent the floor 99, and a valve 104 is connected with the pipe 102. The valve 104 is manually adjustable by a hand grip 105.

A water conveying tube 107 is connected with the valve 104 and conveys water onto the planar surface of the abrasive wheel 60 when the wheel is used in a horizontal position as shown in FIGS. 1 through 3. The tube 107 is preferably flexible and fashioned of resinous plastic, rubber or similar material. The valve 104 may be adjusted to regulate the rate of flow of water delivered onto the wheel or to shut off the water flow.

The upper portion of the end wall 14 of the housing 10 is provided with an access opening or open area 109 to facilitate grinding or processing stones on the periphery of the processing wheel as hereinafter described with the apparatus in the position shown in FIGS. 6 through 9. The opening 109 is defined by side edges 111 and a lower edge 112 of the facets or wall sections 19 and 20, the opening in the wall being above the partition 40 as viewed in FIGS. 1 and 2.

The regions of the housing adjacent the edges 111 and 112 are provided with grooves 114 to slidably accommodate a plate-like member, baffle or water deflector 116. When the abrasive wheel is used in the horizontal position shown in FIGS. 1 through 3, the baffle or plate 116 is slidably inserted in the grooves 114 and serves to deflect water that may be thrown from the wheel 60 into the chamber 42 above the partition 40.

In using the lapidary machine with the abrasive wheel 60 in horizontal position, as shown in FIGS. 1, 2 and 3, water conveyed from the tank 98 by the tube 107 onto the upper planar surface of the abrasive wheel is thrown off by centrifugal forces and is collected in the chamber or compartment 42 above the partition 40. Provision is made for draining away the water collecting in the chamber 42. The partition is provided with a threaded opening 122 close to the inner surface of the housing wall 11, as shown in FIGS. 2 and 3, which receives a tubular fitting 124.

Figure 7:
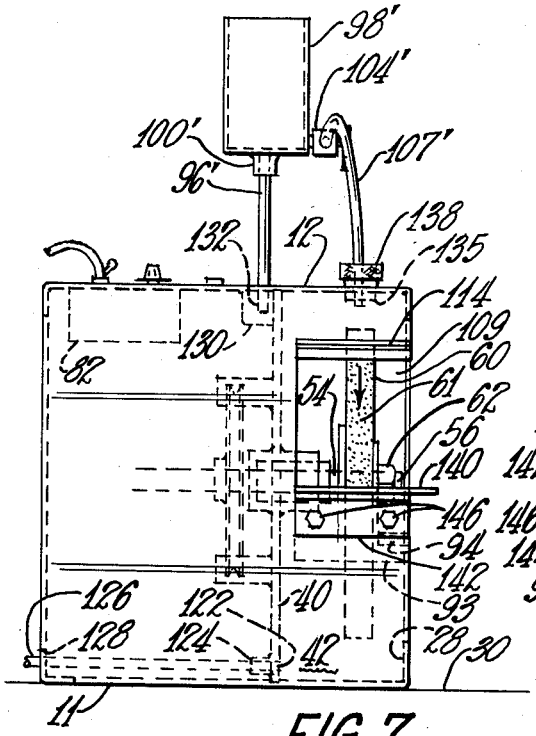
FIG. 7 is an end view of the housing in the position shown in FIG. 6.

A drain tube 126 is connected with the fitting 124, the drain tube extending through a notch or opening 128 in the corner region of the juncture of the wall 11 with the flange 28 as shown in FIGS. 1, 2 and 7 for conveying away water which collects in the chamber or compartment 42.

In the use of the lapidary machine in the position shown in FIGS. 1, 2 and 3, the base flange 28 is supported on a substantially horizontal support surface 30 which may be a table or the like in which position the abrasive wheel 60 is in a substantially horizontal position. The operator manipulates the switch member 90 to energize the electric motor 76 which, through the pulleys 66 and 78 and belt 80, rotates the abrasive wheel 60, and the user processes stones by engaging them with the planar upper surface of the wheel 60.

The operator by manipulating the hand grip 106 regulates the valve 104 for effecting a desired rate of flow of water from the receptacle 98 onto the planar upper surface of the wheel 60. When the wheel is used in the position shown in FIGS. 1, 2 and 3, the baffle plate 116 is inserted in the grooves 114 to deflect water thrown by the wheel by centrifugal forces into the chamber 42 above the partition 40. The water collecting in chamber 42 flows through the fitting 124 and drain tube 126 and is conveyed away from the apparatus.

FIGS. 6 through 9 illustrate the lapidary machine or apparatus disposed in a position shifted 90° from the position shown in FIGS. 1 through 3 to facilitate processing or grinding stones on the periphery of an abrasive or processing wheel with the wheel rotating in a vertical plane. In this position, the wall 11 of the housing is in a horizontal position and is disposed on or supported upon a surface 30 of a table or other support means. In the use of the apparatus with the grinding or processing wheel rotating in a vertical plane, provision is made for delivering water or other liquid onto the periphery 61 of the grinding or processing wheel 60.

Figure 8:
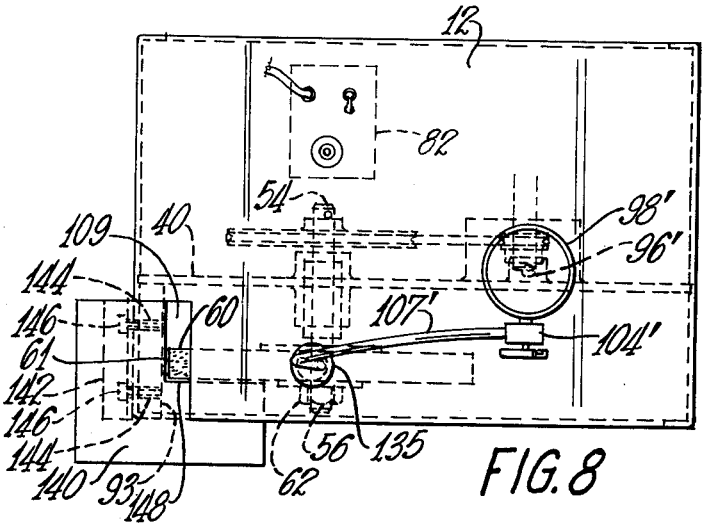
FIG. 8 is a top plan view of the housing when disposed in the position shown in FIGS. 6 and 7.
Figure 6:
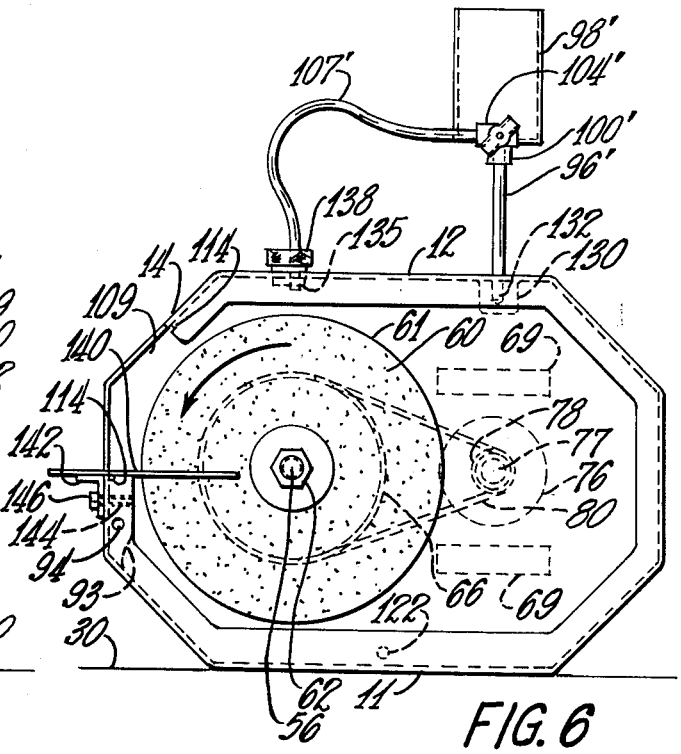
FIG. 6 is a view of the housing shown in FIGS. 1 through 3 with the housing supported in a position disposing a rotatable stone processing instrumentality for rotation in a vertical plane and equipped with a stone supporting means.

Formed as an inwardly extending projection from the housing wall 12 is a boss 130 which is drilled or formed with a bore or cylindrical recess 132 extending partially through the boss 130. As shown in FIGS. 6, 7 and 8, the rod or tank support 96' is slidably inserted into the bore or cylindrical recess 132, the opposite end of the rod 96' being received in the bore or cylindrical recess in the boss 100' depending from the tank or reservoir 98' thus disposing the tank in a vertical position. The water conveying tube 107' is connected with the valve 104'.

Figure 12:
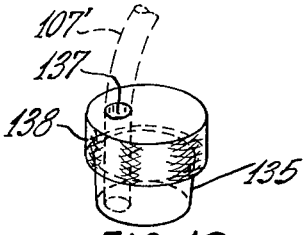
FIG. 12 is an enlarged detail view of an adjustable means for directing a stream of liquid onto the periphery of a stone processing wheel.

The wall 12 of the housing is in a horizontal position as shown in FIGS. 6, 7 and 8. The wall 12 of the housing is provided with an opening accommodating a fitting 135, shown in detail in FIG. 12, which is fashioned with an opening 137 which receives the other end region of the water conveying tube 107'. As shown in FIG. 12, the opening 137 is eccentric with respect to the axis of the cylindrical fitting 135. The fitting 135 is provided with a knurled grip portion 138. The fitting 135 is snugly disposed in the opening in the housing wall 12 whereby the operator may grasp the knurled portion 138 and rotate the fitting 135.

Through the eccentric positioning of the opening 137 in the fitting, the fitting may be manually rotated to adjust the delivery of water from the flexible tube 107' onto desired peripheral regions of the grinding or processing wheel 60. It is to be understood that the components or elements 96', 98', 100', 104' and 107' are the same elements bearing numbers 96, 98, 100, 104, and 107 in FIGS. 1 through 3 but positioned so as to deliver water onto the periphery of the processing wheel 60.

In processing or grinding stones on the periphery of the grinding or processing wheel 60 disposed for rotation in a vertical plane, the water deflector or baffle 116, shown particularly in FIGS. 1 through 4, is slidably removed by the operator from the grooves 114 thus providing access for processing or grinding stones on the periphery of the wheel through the opening 109 in the end wall region 14 of the housing 10 as shown in FIGS. 6, 7, 8 and 9.

In processing or grinding stones on the periphery of the wheel 60 positioned for rotation in a vertical plane, means is provided for supporting the stones during the processing or grinding operations. A table or stone-supporting member 140 is disposed in the opening 109 in the position illustrated in FIGS. 6, 7 and 8 with the plane of the table being horizontal and approximately disposed diametrically with respect to the wheel 60. An L-shaped bracket 142 is welded or otherwise fixedly secured to the table 140.

Figure 10:
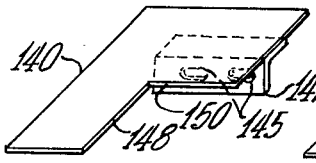
FIG. 10 is an isometric view of a stone supporting table for use with a grinding or polishing wheel.

The table 140 and bracket 142 are shown in detail in FIG. 10. The boss 83 of the housing is provided with threaded openings 144 and the bracket 142 provided with elongated openings or slots 145 accommodating bolts 146 for securing the bracket 142 and table 140 to the housing 10. The bolts 146 are readily removable to remove the table and bracket when the lapidary machine is to be used in a position with the grinding or processing wheel rotating in a horizontal plane as shown in FIGS. 1, 2 and 3.

As particularly shown in FIGS. 8 and 10, the table 140 is generally L-shaped with the edge 148 of the table adjacent the planar side surface of the wheel 60 and the edge 150 disposed adjacent the periphery of the wheel to support stones for processing or grinding with the wheel rotating in a vertical plane. The table is removed which is necessary when the lapidary machine is to be used in the position shown in FIGS. 1 and 2 and the baffle or deflector 116 inserted in the grooves 114.

In the use of the lapidary machine in the position illustrated in FIGS. 6 through 8 with the processing wheel 60 rotatable in a vertical plane, the operator adjusts the fitting 135 by rotating the same in order to impinge the stream of water from the reservoir 98' onto a desired peripheral region of the wheel 60, the rate of flow of water onto the wheel being regulated by the valve 104'.

In this position of the lapidary machine, the portion of the flange 28 connected with the side wall 11, as shown in FIG. 7, forms with the partition 40 the chamber 42 in which water is collected. As the fitting 124 is close to the wall 11, water collecting in the chamber 42 is drained away through the drain tube 126.

Figure 11:
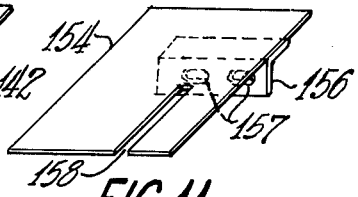
FIG. 11 is an isometric view of a stone supporting table for use with a rotatable stone severing instrumentality.
Figure 9:
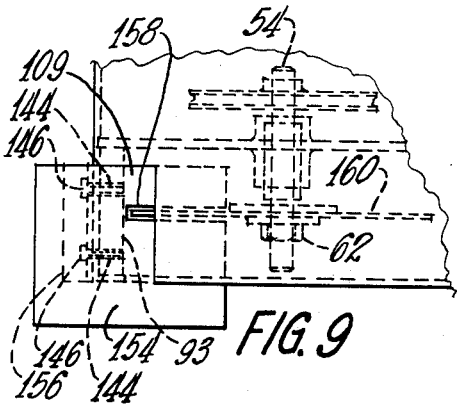
FIG. 9 is a fragmentary view of the apparatus in the position shown in FIG. 8 equipped with a stone severing instrumentality and support means for stones during severing operations.

FIGS. 9 and 11 illustrate adaptation of the apparatus for utilizing a stone severing or diamond cutting wheel and removable means for supporting stones to be severed or cut. A stone-supporting planar metal table or member 154 is provided with an L-shaped bracket 156 substantially identical with the bracket 142. The bracket 156 is welded or otherwise secured to the table 154, the bracket being provided with elongated openings or slots 157 to accommodate the securing screws.

The bracket 156 is provided with openings to accommodate removable members or screws 146 which are threaded into the threaded openings 144 in the boss portion 93. The table 154 is fashioned with a slot or kerf 158 to accommodate a circular saw or processing wheel 160. When it is desired to sever or trim stones supported by the table 154 in the position shown in FIG. 9, the grinding or polishing wheel 60 is removed and the circular saw or cutting wheel 160 mounted on the shaft 54 and the nut 62 drawn up to secure the circular saw on the shaft.

By affixing the table 154 to the housing in the position shown in FIG. 9 and installing a cutting wheel 160 on the shaft 54, stones may be supported by the table 154 and severed, sawed or trimmed by engagement of the stones with the periphery of the circular saw 160. The tables 140 and 154 are readily removable so that the deflector 116, shown in FIG. 4, may be inserted in the grooves 114 closing the opening 109 when the apparatus is used with the processing or grinding wheel 60 in a horizontal position as illustrated in FIGS. 1, 2 and 3.

Figure 13:
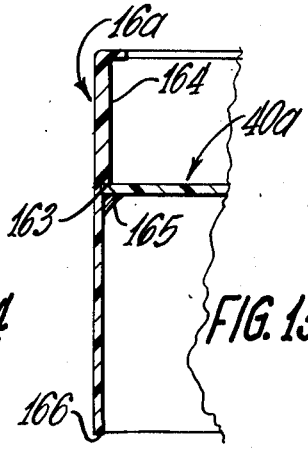
FIG. 13 is a fragmentary sectional view showing a modified form of housing construction.
Figure 5:
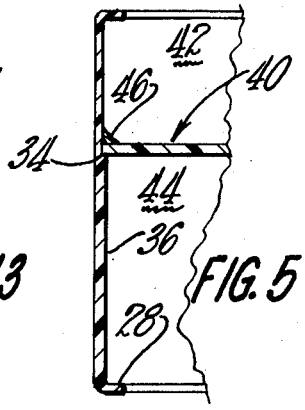
FIG. 5 is a fragmentary sectional view through a portion of the housing illustrated in FIG. 1.

FIG. 13 illustrates a modified form of housing and partition construction. In this form partition 40*a* is engaged with a ledge 163 provided by the thickened region 164 of the housing walls above the partition. A cementitious material 165 is applied to secure the partition 40*a* to the housing and provide a fluid-tight seal. In this form of housing the flange at the lower terminus of the housing wall is eliminated, and the surface of the edge region 166 of the wall structure provides the support surface for the housing with the stone-processing instrumentality rotating in a horizontal plane.

Figure 14:
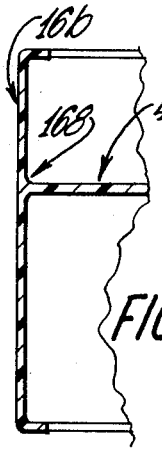
FIG. 14 is a fragmentary sectional view showing another form of housing construction.

FIG. 14 illustrates a modification in which the partition 40*b* is integrally joined with the walls of the housing 16*b* at the region indicated at 168. The housing and partition construction shown in FIG. 14 is of resinous plastic material and the housing 16*b* and the partition 40*b* are molded or formed as a unit.

Figure 15:
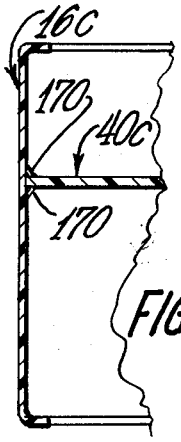
FIG. 15 is a fragmentary sectional view showing a further modification of housing construction.

FIG. 15 illustrates further modification of the housing and partition construction. In this form the partition 40*c* is positioned as shown in FIG. 15, and a cementitious material 170 is applied at the region of engagement of the partition 40*c* with the walls of the housing 16*c* to retain the partition in its proper position. The cementitious material 170 provides a seal to prevent leakage of water which is collected in the chamber adjacent the partition.

The housing and partition construction may be formed of various resins. For example, thermoplastic resins, such as acrylic resin, polyester resin and the like may be used. Thermosetting resins may be used for the housing construction such as melamine formaldehyde, phenol formaldehyde or the like. The housing construction may be molded of polyurethane, this material providing a high strength construction of minimum weight by reason of the cellular characteristics of the material.

From the foregoing it will be seen that the stone processing or lapidary apparatus is of compact, lightweight construction wherein the rotatable shaft or arbor is adapted to mount various types of stone processing wheels such as stone cutting, abrading, grinding or polishing wheels so that various processing operations may be performed on stones. By shifting the position of the apparatus as herein described, the user is enabled to conveniently process stones by engaging the stones with a planar surface of a rotatable processing instrumentality or engaging the stones with the peripheral surface of a rotatable instrumentality.

It is apparent that, within the scope of the invention, modifications and different arrangements may be made other than as herein disclosed, and the present disclosure is illustrative merely, the invention comprehending all variations thereof.

We claim:

1. Apparatus for processing stones comprising, in combination, a hollow housing having connected walls, an end region of the housing providing a support surface for the housing in one position, one of said walls providing a support surface for the housing in a second position, partition means in said housing providing first and second compartments in the housing, means journally mounting a rotatable stone-processing instrumentality in said first compartment, motive means in the second compartment for rotating the stone-processing instrumentality, the housing in one position disposing the instrumentality for rotation in a substantially horizontal plane and in the second position disposing the instrumentality for rotation in a substantially vertical plane, a reservoir supported by the housing adapted to contain a liquid, tubular means connected with the reservoir for conveying liquid from the reservoir onto the stone-processing instrumentality, the end regions of the connected walls adjacent the stone-processing instrumentality having an inwardly extending flange means, said flange means and said first compartment providing a chamber for receiving liquid thrown from the instrumentality with the housing disposed in its respective positions, and a table mounted by the housing for supporting stones for processing with the instrumentality disposed in a vertical plane.

2. Apparatus for processing stones comprising, in combination, a hollow housing having connected walls, an end region of the housing providing a support surface for the housing in one position, one of said walls providing a support surface for the housing in a second position, partition means in said housing providing first and second compartments in the housing, means journally mounting a rotatable stone-processing instrumentality in said first compartment, motive means in the second compartment for rotating the stone-processing instrumentality, the housing in one position disposing the instrumentality for rotation in a substantially horizontal plane and in the second position disposing the instrumentality for rotation in a substantially vertical plane, a reservoir supported by the housing adapted to contain a liquid, tubular means connected with the reservoir for conveying liquid from the reservoir onto the stone-processing instrumentality, the end regions of the connected walls adjacent the stone-processing instrumentality having an inwardly extending flange means, said flange means and said first compartment providing a chamber for receiving liquid thrown from the instrumentality with the housing disposed in its respective positions, a wall region of the housing adjacent the stone-processing instrumentality having an open area for processing stones with the instrumentality disposed in a vertical plane, and a removable baffle for said open area for deflecting water thrown from the instrumentality into the liquid receiving chamber.

3. Apparatus for processing stones comprising, in combination, a walled hollow housing, said housing having one surface area for mounting the housing in one position, said housing having a second surface for mounting the housing in a second position, partition means in said housing providing two compartments in the housing, means journally mounting a rotatable stone-processing instrumentality in one of said compartments, motive means disposed in the other of said compartments for rotating the stone-processing instrumentality, the housing in one position disposing the instrumentality for rotation in a substantially horizontal plane and in the second position disposing the instrumentality for rotation in a substantially vertical plane, a reservoir adapted to contain a liquid, tubular means connected with the reservoir for conveying liquid from the reservoir onto the stone-processing instrumentality, said housing having a first means for mounting the reservoir when the reservoir and tubular means are disposed for delivering liquid onto a planar surface of the stone-processing instrumentality, said housing having a second means for mounting the reservoir when the housing is in said second position whereby the tubular means conveys liquid for delivery onto the periphery of the stone-processing instrumentality.

4. Apparatus for processing stones comprising, in combination, a walled hollow housing, said housing having one surface area for mounting the housing in one position, said housing having a second surface area for mounting the housing in a second position, partition means in said housing providing two compartments in the housing, means journally mounting a rotatable stone-processing instrumentality in one of said compartments, motive means disposed in the other of said compartments for rotating the stone-processing instrumentality, the housing in one position disposing the instrumentality for rotation in a substantially horizontal plane and in the second position disposing the instrumentality for rotation in a substantially vertical plane, a reservoir adapted to contain a liquid, tubular means connected with the reservoir for conveying liquid from the reservoir onto the stone-processing instrumentality, a wall of the housing adjacent the periphery of the stone-processing instrumentality being provided with an opening, an adjustable fitting associated with the opening in the housing, said fitting having an opening accommodating the tubular means, said fitting being adjustable to control the region of delivery of liquid from the tubular means onto a selected region of the periphery of the stone-processing instrumentality.

5. Apparatus for processing stones comprising, in combination, a walled hollow housing, said housing having one surface area for mounting the housing in one position, said housing having a second surface area for mounting the housing in a second position, partition means in said housing providing two compartments in the housing, means journally mounting a rotatable stone-processing instrumentality in one of said compartments, motive means disposed in the other of said compartments for rotating the stone-processing instrumentality, the housing in one position disposing the instrumentality for rotation in a substantially horizontal plane and in the second position disposing the instrumentality for rotation in a substantially vertical plane, a reservoir adapted to contain a liquid, tubular means connected with the reservoir for conveying liquid from the reservoir onto the stone-processing instrumentality, a wall of the housing adjacent the periphery of the stone-processing instrumentality being provided with an opening, an adjustable fitting associated with the opening in the housing, said fitting having an opening accommodating the tubular means, said fitting being adjustable to control the region of delivery of liquid from the tubular means onto a selected region of the periphery of the stone-processing instrumentality, the adjustable fitting having a cylindrical portion received in the opening in the housing, the opening in the fitting being eccentrically disposed with respect to the axis of the cylindrical portion, the fitting being rotatable to control the region of delivery of the liquid from the tubular means onto a selected region of the periphery of the stone-processing instrumentality.

6. Apparatus for processing stones comprising, in combination, a walled hollow housing, said housing having one surface area for mounting the housing in one position, said housing having a second surface area for mounting the housing in a second position, partition means in said housing providing first and second compartments in the housing, means journally mounting a rotatable stone-processing instrumentality in the first compartment, motive means disposed in the second compartment for rotating the stone-processing instrumentality, the housing in one position disposing the instrumentality for rotation in a substantially horizontal plane and in the second position disposing the instrumentality for rotation in a substantially vertical plane, a reservoir adapted to contain a supply of liquid, first tubular means connected with the reservoir for conveying liquid from the reservoir onto the stone-processing instrumentality, said housing having a first means for mounting the reservoir when the reservoir and first tubular means are disposed for delivering liquid onto a planar surface of the stone-processing instrumentality in horizontal position, said housing having a second means for mounting the reservoir when the housing is in said second position whereby the first tubular means conveys liquid for delivery onto the periphery of the stone-processing instrumentality in vertical position, a wall of the housing having flange means providing with the first compartment a chamber to collect water thrown from the stone-processing instrumentality, and second tubular means connected with the first compartment for conveying away liquid from the chamber when the instrumentality is in horizontal and vertical positions.

7. Apparatus for processing stones comprising, in combination, a hollow housing having connected walls, an end region providing a support surface for the housing in one position, one of said walls providing a support surface for the housing in a second position, partition means in said housing providing two compartments in the housing, a shaft journally supported by said partition means for mounting a stone-processing instrumentality in the first compartment, motive means mounted by the partition means for rotating the shaft and stone-processing instrumentality, a reservoir adapted to contain a liquid, a member connected with the reservoir, a liquid conveying tube connected with the reservoir, said housing having a first recess receiving said member supporting the reservoir in a position whereby liquid is delivered from the liquid conveying tube onto a planar surface of the stone-procesing instrumentality with the housing in the first position and the stone-processing instrumentality rotatable about a vertical axis, and a second recess in the housing receiving said member to support the reservoir in a position for delivering liquid through the tube onto the peripheral region of the stone-processing instrumentality when the housing is disposed in the second position with the stone-processing instrumentality rotatable about a horizontal axis.

8. The combination according to claim 7 wherein the compartment containing the stone-processing instrumentality provides a chamber receiving liquid thrown from the stone-processing instrumentality, and tubular means connected with an opening in the partition means for conveying away liquid collected in the chamber.

9. The combination according to claim 7 wherein the motive means comprises a variable speed electrically-energizable motor, and operator-controlled means for varying the speed of the motor.

10. The combination according to claim 8 wherein a wall region of the housing has an access opening for processing stones on the periphery of the stone-processing instrumentality, said opening being defined by a groove in the region of the housing wall at the opening, and a removable baffle means slidably received in said groove for deflecting liquid thrown from the grinding wheel when the grinding wheel is in a position rotating about a vertical axis.

11. The combination according to claim 10 including a table for supporting stones for processing operations, and means for removably securing the table adjacent the access opening.

* * * * *